US007195543B2

(12) United States Patent
Cousin

(10) Patent No.: US 7,195,543 B2
(45) Date of Patent: Mar. 27, 2007

(54) MACHINE TOOL WITH 5 MACHINING AXES WITH A CONTINUOUS GRINDING TOOL PROFILLING SYSTEM

(76) Inventor: Thierry Cousin, 1, rue du Clos Bodeau, 41500 Menars (FR)

( * ) Notice: Subject to any disclaimer, the term of this patent is extended or adjusted under 35 U.S.C. 154(b) by 276 days.

(21) Appl. No.: 10/959,593

(22) Filed: Oct. 6, 2004

(65) Prior Publication Data

US 2005/0118928 A1 Jun. 2, 2005

(30) Foreign Application Priority Data

Oct. 7, 2003 (FR) ..... 03 11710

(51) Int. Cl.
*B24B 49/00* (2006.01)
*B24B 51/00* (2006.01)

(52) U.S. Cl. ..... 451/9; 451/21; 451/22; 451/56; 451/72; 451/443

(58) Field of Classification Search ..... 451/5, 451/8, 9, 10, 11, 14, 21, 22, 49, 53, 56, 72, 451/178, 443, 449, 450, 488
See application file for complete search history.

(56) References Cited

U.S. PATENT DOCUMENTS 4,151,684 A * 5/1979 Wada et al. ..... 451/21
4,417,422 A * 11/1983 Redeker et al. ..... 451/143
4,557,078 A * 12/1985 Brill ..... 451/21
4,619,078 A * 10/1986 Uhlig ..... 451/5
4,897,964 A * 2/1990 Vetter ..... 451/72
5,595,528 A * 1/1997 Becker ..... 451/72
5,957,752 A * 9/1999 Katakura ..... 451/10
6,454,636 B1 * 9/2002 Iwabuchi ..... 451/53
6,666,748 B2 * 12/2003 Hiramoto et al. ..... 451/5

* cited by examiner

*Primary Examiner*—Timothy V. Eley
(74) *Attorney, Agent, or Firm*—Perman & Green, LLP

(57) ABSTRACT

A machine tool for machining a part by on-head and continuous grinding tool profiling includes a part holder support driven into rotation by first driving means around a first axis in a vertical plane, a machining system provided with a grinding tool for machining the part, and a knurl for profiling the grinding tool. The first driving means are incorporated into a cradle driven into rotation by second driving means along a second axis perpendicular to the vertical plane. The machining system includes a bearing structure translationally mobile along three axes equipped with a main spindle for rotating the grinding tool, and a rotating device bound to the bearing structure and provided with a secondary spindle integral with the knurl moving around the axis of rotation of the grinding pool.

16 Claims, 3 Drawing Sheets

MACHINE TOOL WITH 5 MACHINING AXES WITH A CONTINUOUS GRINDING TOOL PROFILLING SYSTEM

CROSS-REFERENCE TO RELATED APPLICATIONS

This application claims priority from French Patent Application No. 0311710 filed Oct. 7, 2003.

BACKGROUND OF THE INVENTION

1. Field of the Invention

The present invention relates to the field of precision manufacturing of machined parts. The invention more specifically relates to a machine tool with 5 machining axes with a continuous grinding tool profiling system.

2. Brief Description of Related Developments

A system for continuous on-head profiling of grinding tools is known from the prior art according to which a knurl with the intended shape for the part, profiles a grinding tool which itself machines the part, in order to produce parts with good finishing and good precision. This system was adapted in the prior art to grinders including up to four degrees of freedom for machining, also called machining axes. The fact of including only up to four machining axes, prevents use of the machining tool for producing parts with complex shapes.

Other three-dimensional cutting machine tools, as with a mill, used for producing parts with complex shapes, may operate with more than 4 machining axes but they do not have optimal finishing and precision and often the parts machined by these machines need to be reworked with grinders. In the prior art, machines with 4 or more machining axes are not suitable for machining while continuously profiling the grinding tool.

SUMMARY OF THE INVENTION

The object of the present invention is to overcome certain drawbacks from the prior art by providing a machine tool enabling a part of any shape to be machined by continuous on-head grinding tool profiling, along 5 machining axes.

This object is achieved by a machine tool for machining a part with complex shape by on-head continuous profiling of a grinding tool, comprising a frame, a part holder support driven into rotation by first driving means around a first axis included in a vertical plane, a machining system provided with a grinding tool for machining the part and with a profiling knurl for profiling the grinding tool, characterized in that said first driving means are incorporated into a mobile cradle driven into rotation by second driving means along a second horizontal axis perpendicular to said vertical plane, the profiling system comprising a bearing structure, translationally mobile along three axes, the bearing structure being integral with the frame and equipped with a main spindle for rotating the grinding tool, a rotating device bound to the bearing structure and provided with a secondary spindle integral with the knurl moving around the axis of rotation of the grinding tool.

According to another feature of the invention, the axis of the grinding tool and the axis of the knurl are kept vertical, the rotating device comprising means for translationally moving a support of the secondary spindle in order to position the knurl against the grinding tool.

According to another feature, the translational moving means comprise guiding rails of the support of the secondary spindle and a worm system for adjusting the distance between the axis of the knurl and the axis of the grinding tool.

According to another feature, an assembly with an arm is fixed to the cradle and includes means for adjusting the height of the arm in order to hold a said upper end of the part via a spike located at the free end of the arm.

According to another feature of the invention, the first driving means Include a motorization component and a rotary shaft connected to the part holder support, the rotary shaft, the part holder support and the spike at the end of the arm being aligned along said first said axis.

According to another feature, the bearing structure of the profiling system positioned above the cradle, is bound to the frame by a system with three crossed slides, the translational movements of the machining system along the three perpendicular axes of the slides being actuated by a central control unit according to a predetermined continuous machining program.

According to another feature, the second driving means, integral with the frame, are connected to a motorization component in order to cause the cradle to pivot between two limiting positions on either side of the vertical plane passing through the second horizontal axis.

According to another feature, the rotating device is driven into rotation around the axis of the grinding tool via third driving means servo-controlled by a system for controlling said reference position representative of the position of the axis of the grinding tool, the control system actuating the third driving means so that the rotating device occupies an angular position relatively to the axis of the grinding tool, so as to keep a safety angle preventing any collision between the knurl, the part to be machined and the machine units, while allowing the part and the grinding tool to be optimally sprayed by at least one spraying nozzle.

According to another feature, the rotating device is driven into rotation around the axis of the grinding tool via third driving means controlled by the central control unit.

According to another feature, the safety angle is directly handled by a parameter of the machining program.

According to another feature, the third driving means include either a gear formed by the central sprocket wheel, the axis of which coincides with the axis of the grinding wheel, and a peripheral sprocket wheel integral with the rotating device bearing the knurl, or a system with synchronous belt and pulley.

According to another feature, a motorized component with numerical control and servo-controlled by the reference position control system is laid out so as to cause the peripheral sprocket wheel to rotate around the central sprocket wheel in any direction of rotation according to the reference position.

According to another feature, a motorized component with a numeric control and servo-controlled by tho reference position control system is laid out so as to cause the peripheral sprocket wheel to rotate around the central sprocket wheel in any direction of rotation according to the machining program.

According to another feature, the main spindle is driven into rotation by an adjustable speed motor and provided with means for reversing the direction of rotation.

According to another feature, the profiling knurl is diamondized and driven into rotation by the secondary spindle via an adjustable speed air or electric motor.

According to another feature, a spraying system is bound to the rotating device in order to spray the part.

According to another feature, the central control unit is coupled with a module for calculating the position of the part in order to control and servo-control the first and second driving means, so as to obtain an orientation of the part allowing its machining according to the program corresponding to the desired part shape.

BRIEF DESCRIPTION OF THE DRAWINGS

Other features and advantages of the present invention will become more apparent upon reading the description hereafter, made with reference to the appended drawings wherein.

DETAILED DESCRIPTION OF THE PREFERRED EMBODIMENT(S)

Figure 1:
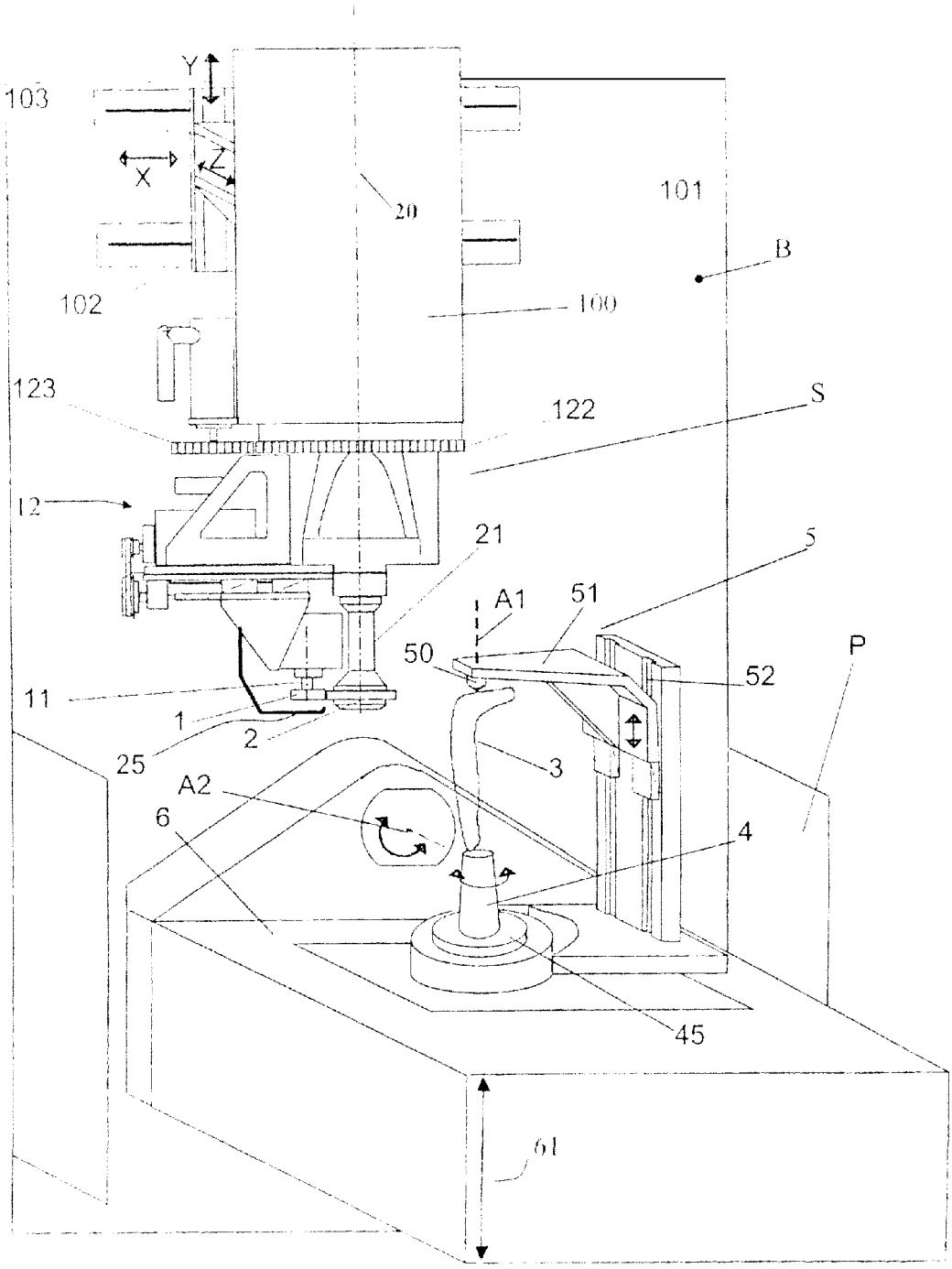
FIG. 1 schematically illustrates, in a perspective view, an embodiment of a machine tool according to the invention.

As illustrated in FIG. 1, the machine tool includes a frame (B) and a mobile cradle (6) provided with a part holder support (4). The part holder support (4) is driven into rotation around a first axis (Al) by first driving means incorporated into the cradle (6). In the embodiment of FIG. 1, an assembly (5) with an arm (51) is fixed to the cradle (6) in order to ensure that the pan (3) to be machined is held in position. The assembly (5) includes means (52) for adjusting the height of the arm (51) in order to hold a so-called upper end of the part (3) via a spike (50) located at the free end of the arm (51). The part is clamped between the part holder support (4) for example consisting of a puppet, and the spike (50). The arm (51) may be moved towards the part holder support (4) by sliding on a rail (52), so as to position and press the spike (5) against the part (3) and to perform damping of the part. With screwing, blocking or clamping components, which may be inserted at different height levels on the rails (52), the height of the spike (50) may be adjusted accurately. The height of the spike (50) may be adjusted with electric motors or actuators. For example, the arm (51) is of suitable dimensions so that the spike (50) is placed at the vertical of the part holder support (4) when the cradle (6) is in an horizontal position. The part holder support (4) drives the part (3) into rotation in both directions along the first axis (A1) passing through the spike (50).

Figure 2:
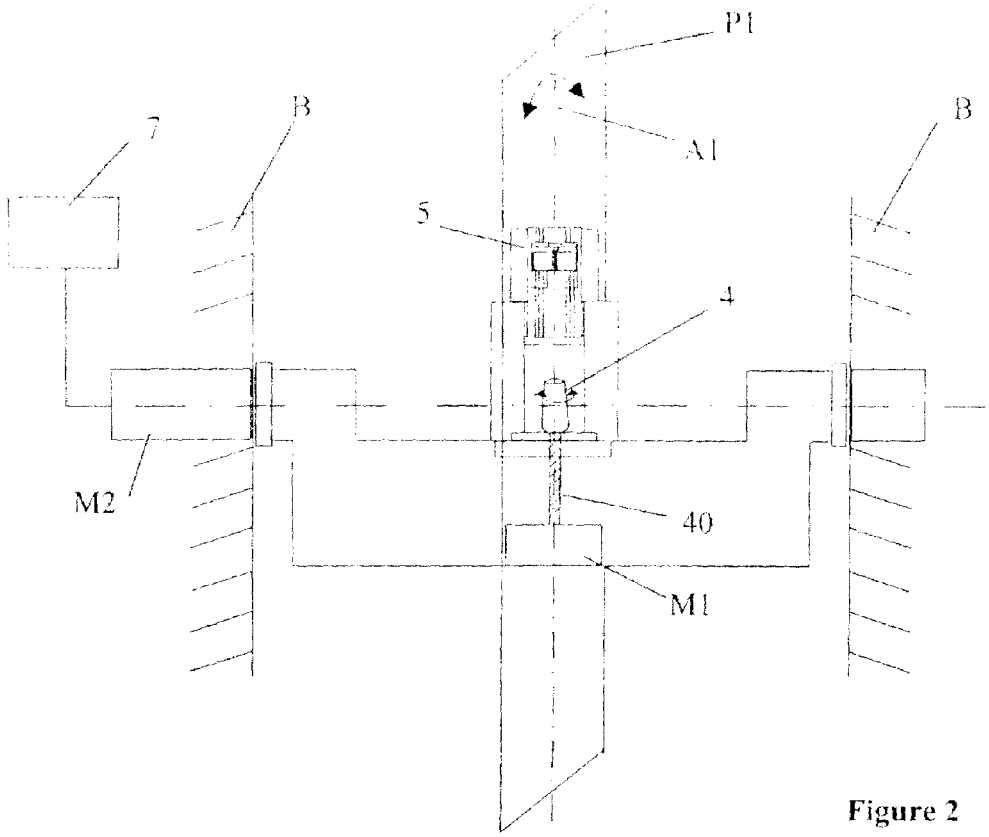
FIG. 2 illustrates a profile view of the cradle equipped with the part holder support and with the arm for holding the part.

The mobile cradle (6) is driven into rotation by second driving means integral with the frame (B) along a second axis (A2) which is horizontal. For example the cradle (6) may swing between two limiting positions on either side of the vertical plane passing through the second axis (A2), by a rotary motion around this horizontal axis (A2). As illustrated in FIG. 2, whereas the cradle pivots around the second axis (A2), the axis of rotation (A1) of the part holder support (4) remains in a vertical plane (P1) perpendicular to the axis of rotation (A2) of the cradle. Safety panels (P) or partitions may be positioned along the flanks of the cradle (6). Alternatively the cradle (6) may be surrounded by a safety enclosure.

The first driving means for the part holder support (4) may include a shaft (40) directly actuated by an electrical motor (M1). The rotary shaft (40) is for example connected to the part holder support (4), aligned with the part holder support and spike (50) along the first axis (A1). This electric motor (M1) is placed inside the cradle (6), the thickness (61) of which is for example of the order of 30 centimeters. In the example of FIG. 2, the rotary shaft (40) rotates a plate-form (45) on which is fixed the part holder support (4). The second driving means are connected to a motorization component (M2) incorporated in the frame (B) in order to cause the cradle (6) to pivot between both limiting positions (not shown). The cradle (6) may be suspended via one or two bearings.

In an embodiment of the invention, a module (7) for calculating the position of the part (3) permanently takes into account representative data of the rotational movements performed by the first and second driving means. This calculation module (7) may be directly connected to the motorization component (M2) of the second driving means and may receive, at regular intervals or continuously, data from a sensor indicating the position of the part holder support (4) put into rotation by the first driving means. The calculation module (7) is connected to a central control unit (not shown) for controlling the first and second driving means in order to change the orientation of the part (3) to allow its machining according to a machining program corresponding to the desired part shape. The calculation module (7) provides servo-control of the first and second driving means. In other words, with the coupling of the central control unit with this module (7) for calculating the position of the part, it is possible to control and adjust if necessary the controls performed by the central control unit for the first and second driving means, so as to obtain a controlled orientation of the part (3) to be machined. Correct execution of the program may thereby be checked by the calculation module (7). The central control unit may for example immediately interrupt the machining as soon as the part's orientation data obtained by the calculation module (7) do not match the predictions of the program.

As illustrated in FIG. 1 the machine tool includes a machining system (S) provided with a grinding tool (2) for machining the part (3) and a profiling knurl (1) for profiling the grinding tool (2). The machining system is integral with the frame (B) and comprises a bearing structure (100) translationally mobile along three axes (X, Y, Z). In the preferred embodiment of the invention, the bearing structure (100) remains upright, the axis (20) of the grinding tool (2) and the axis (10) of the knurl (1) being held vertical. In the example of FIG. 1, this bearing structure (100) is positioned above the cradle (6) and bound to the frame (B) by a system with three cross-slides (101, 102, and 103). The translational movements of the machining system (S) are performed along the three perpendicular axes of the slides (101, 102 and 103), along a longitudinal horizontal axis (Z) relatively to the cradle (6), along a transverse horizontal axis (X) relatively to the cradle (6) and along a vertical axis (Y), respectively. In one embodiment, the slides (101, 102 and 103) may be equipped with geared motor components, with the actuators or an equivalent displacement system for changing the positioning of the bearing structure (100) relatively to the part to be machined. The geared motor components or equivalents are actuated by the central control unit according to the continuous machining program. Other translational displacement units of a known type may of course be contemplated for adjusting the positioning of the bearing structure (100).

The invention will now be described in connection with FIGS. 1 and 3.

The bearing structure (100) is equipped with a main spindle (21) to rotate the grinding tool (2). A rotating device (12) bound to the bearing structure and provided with a secondary spindle (11) integral with the knurl (1) moves around the axis of rotation (20) of the grinding tool (2). The profiling knurl (1) may rotate around the grinding tool (2) during the machining of a part (3) with complex shapes, the position of the grinding tool (2) may thereby change without the knurl (1) being an obstacle.

Figure 3:
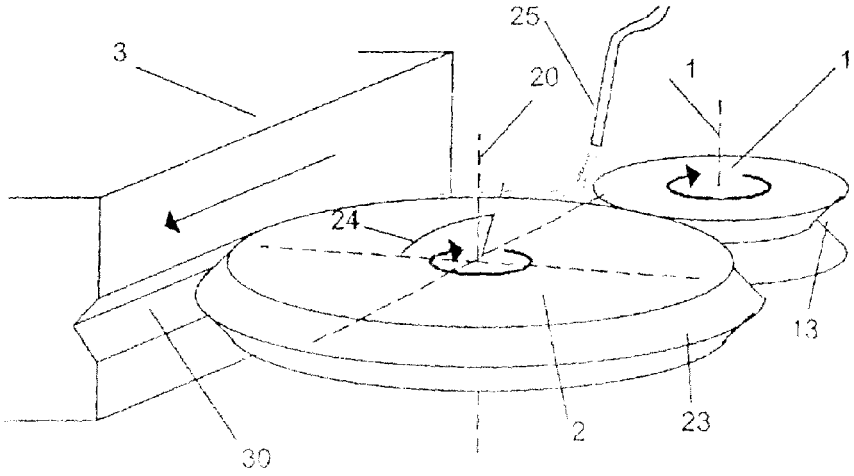
FIG. 3 illustrates the machining of the part achieved with the grinding tool, and the profiling of the grinding tool achieved by the knurl.

This profiling knurl (1) as illustrated in FIG. 3, includes a determined profile (13) complementary to the profile (23) of the grinding tool (2). The knurl (1) may be driven into rotation with the secondary spindle (11) via an adjustable speed air or electric motor. The grinding tool (2) cuts out, in the part (3), a groove (30) with a section complementary to the profile (23) of the grinding tool (2). Consequently, it is understood as illustrated in FIG. 3, that the groove (30) of the part (3) has the same section as the profile (13) of the knurl (1). In the preferred embodiment of the invention, this knurl (1) is diamondized.

Figure 4:
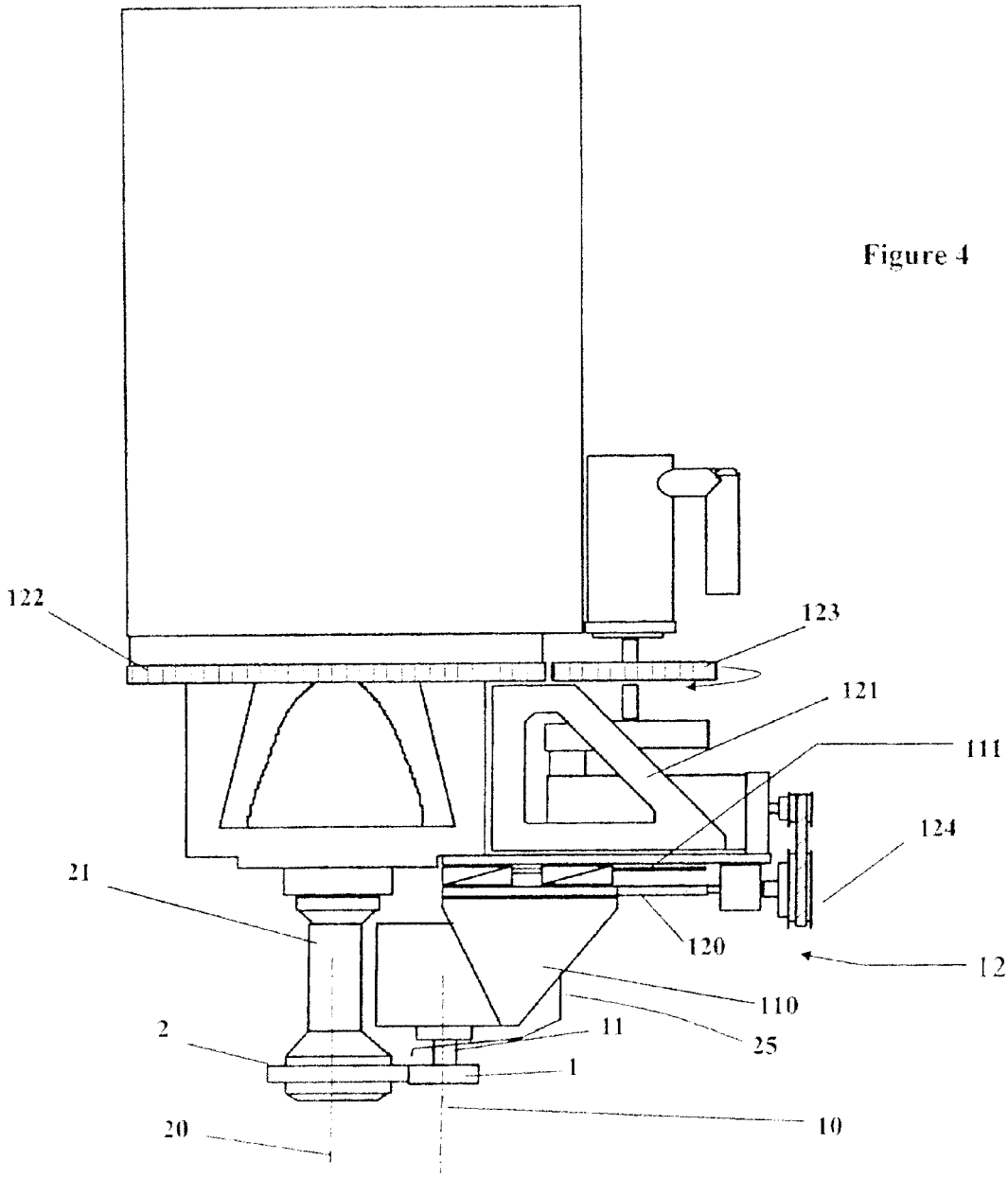
FIG. 4 illustrates a front view of the profiling system.

The invention will now be described with reference to FIGS. 1 and 4.

In one embodiment of the invention, the secondary spindle (11) is electrical or pneumatic and mounted on a right-angled bracket (110). The rotating device (12) comprises means for translationally displacing this right-angled bracket (110) in order to position the knurl (1) against the grinding tool (2). Thus, the rotating device (12) which supports the secondary spindle (11) for example includes guiding rails (111) of the right-angled bracket (110). A worm screw system (120, 124) or the like, enables the displacement of the right-angled bracket (110) to be controlled so as to adjust the distance between the axis (10) of the knurl (1) and the axis (20) of the grinding tool (2), either to bring the knurl (1) closer to the axis (20) of the grinding tool (2) as the grinding tool (2) is worn away, or to move the knurl (1) away from the axis (20) of the grinding tool during replacement of the grinding tool (2) or of the knurl (1). The presence of a worm screw (120) provides high precision adjustment. The guiding rail (111) may be provided with a measure in order to know the distance of the knurl (1) from the axis (20) of the grinding tool and to thereby calculate in real time the radius of the grinding tool (2). The rail (111) is fixed on the rotating device (12) which may pivot around the axis (20) of the grinding tool (2).

The main spindle (21) is driven into rotation by an adjustable speed electrical or air motor. This motor (not shown) may be provided with means for reversing the direction of rotation of the main spindle (21). In an embodiment of the invention, the rotating device (12) is driven into rotation around the axis of the grinding tool (2) via third driving means. As illustrated in FIGS. 1 and 4, these third driving means may include a gear formed with a central sprocket wheel (122), the axis of which coincides with the axis (20) of the grinding tool (2), and with a peripheral sprocket wheel (123) integral with the rotating device (12) bearing the knurl (1). Alternatively, these third driving means may comprise a system with a synchronous belt and pulley.

In a first alternative embodiment, a motorized component with numerical control is servo-controlled by a system for controlling a so-called reference position representative of the position of the axis (20) of the grinding tool (2), so that the peripheral sprocket wheel (123) may rotate around the central sprocket wheel (122) in any direction of rotation according to the reference position. The control system (not shown) actuates numerical control so that the motorized component of said third driving means displaces the peripheral wheel (123) in such a way that the rotating device (12) occupies an angular position relatively to the axis (20) of the grinding tool (2) so as to keep a safety angle (24) preventing any collision between the knurl (1), the part to be machined (3) and the machine units, while providing optimized spraying of the part (3) and the grinding tool (2), with at least a spraying nozzle (25). The nozzle (25) is coupled to a spraying shoe. The safety angle (24) is directly handled by a parameter of the machining program for example.

It is understood that during the continuous machining of the part (3), while the machining program is applied via the central control unit, the control system will order the rotating device (12) to move whenever the safety angle (24) of the knurl (1) is no longer observed. In this way, the knurl (1) i2s actually displaced so that there is no contact between the part (3), the knurl (1), and the machine units. In a second alternative embodiment of the invention, the central control unit is the unit which actuates the displacements of the rotating device (12), according to the change in the predetermined machining program. The position angle of the knurl (1) may thereby be servo-controlled and numerically controlled. Data from the calculation module (7), representative of the rotational movements performed by the first and second driving means, may also be taken into account by the central control unit for actuating the rotating device (12).

The central control unit may consist of a numerical control system with which for example, by knowing the distance of the knurl (1) from the axis (20) of the grinding tool (2), the radius of the grinding tool may be calculated and its wear may be compensated by bringing the part (3) closer to the axis (20) of the grinding tool (2) by the same distance by which it brings the knurl (1) closer to the axis (20) of the grinding tool (2). In an embodiment of the invention, the speeds of the motors of the spindles (11, 21) of the knurl (1) and of the grinding tool (2) may be servo-controlled.

In an embodiment of the invention, a spraying system is provided for preventing the heating up of the tools. The spraying system (not shown) is for example bound to the rotating device (12) in order to spray the part (3). The orientation of the spraying aperture is turned towards the grinding tool (2), the part to be machined (3) will be sprayed continuously as the rotating device will follow the displacements of the part (3).

The grinding tool (2) is made of abrasive crystals. The motors used for driving the knurl's support into rotation around the axis (20) of the grinding tool, the part holder support (4), the cradle (6) and for displacing the right-angled bracket (110) of the knurl are preferably electric motors. The motors used for driving into rotation the spindle (21) of the grinding tool (2) and the spindle (11) of the knurl (1) are preferably electric or air motors. The other components for the machine may each be made of steel, of alloy or hard ceramic or steel, of alloy or hard ceramic with a low expansion coefficient, such as invar, in order to increase the precision of the assembly.

Grinding tools are tools normally used for finishing and grinding operations because of their high precision. One of the advantages of the invention is the high precision continuous machining of a part (3) and the fact of not requiring any additional grinding or finishing.

By the layout of the axes of movement of the part (3) and as the knurl (1) may be displaced so as to remain opposite to the contact point between the grinding tool (2) and the part (3), any point of the part (3) may be turned towards the grinding tool (2) under any angle. Another advantage of the invention therefore allows grooves (30) to be machined with a very high precision along all angles and thus allows parts to be manufactured with complex shapes. The invention provides the possibility of carrying out the machining operations for example circular machining operations, continuously.

With the possibility of rotating the machining system (S) around the machining tool, it is possible, in a determined position of the machining system (S), to fetch with the head, in a tool holder magazine close at hand, the tool to be placed on the axis of the main grinding tool holder spindle.

It should be clear for one skilled in the art that the present invention may be embodied under many other specific forms without departing from the field of application of the invention as claimed. Therefore, the present embodiments should be considered as illustrative, but they may be changed within the field defined by the scope of the appended claims, and the invention should not be limited to the details given above.

The invention claimed is:

1. A machine tool for machining a part with complex shapes, comprising a frame, a part holder support driven into rotation by first driving means around a first axis included in a vertical plane, a machining system provided with a grinding tool for machining the part and a profiling knurl for continuously profiling the grinding tool, characterized in that said first driving means are incorporated into a mobile cradle driven into rotation by second driving means along a second horizontal axis perpendicular to said vertical plane, the machining system comprising:

a bearing structure translationally mobile along three axes, the bearing structure being integral with the frame and equipped with a main spindle for rotating the grinding tool, a rotating device bound to said bearing structure, said rotating device moving around an axis of rotation of the grinding tool and including a secondary spindle for rotating the knurl.

2. The machine tool according to claim 1, wherein the axis of rotation (20) of the grinding tool and the axis of knurl are vertical axis, the rotating device comprising means for translationally displacing a support of the secondary spindle in order to position the knurl against the grinding tool.

3. The machine tool according to claim 2, wherein the translation displacement means comprise guiding rails (111) of a support of the secondary spindle and a worm screw system (120, 124) for adjusting the distance between the axis of the knurl and the axis of the grinding tool.

4. The machine tool according to claim 1, wherein an assembly with an arm is fixed to the cradle and includes means for adjusting the height of the arm in order to hold a so-called upper end of the part via a spike located at a free end of the arm.

5. The machine tool according to claim 4, wherein the first driving means include a motorization component and a rotary shaft connected to the part holder support, the rotary shaft, the part holder support and the spike at the end of the arm being aligned along said first axis.

6. The machine tool according to claim 1, wherein toe bearing structure of the machining system, positioned above the cradle, is bound to the frame by a system with three crossed sides, the translational movements of the machining system along three respective perpendicular axes of said slides being actuated by a central control unit according to a predetermined continuous machining program.

7. The machine tool according to claim 6, wherein the rotating device is driven into rotation around the axis of the grinding tool via third driving means controlled by the central control unit.

8. The machine tool according to claim 6, wherein said central control unit actuates movements of said part by controlling said first and second driving means and is coupled to a module for calculating the position of the part in order to control and servo-control the first and second driving means, so as to obtain an orientation of the part.

9. The machine tool according to claim 1, wherein the second driving means, integral with the frame, are connected to a motorization component in order to cause the cradle to pivot between two limiting positions on either side of the vertical plane passing through the second horizontal axis.

10. The machine tool according to claim 1, comprising:

third driving means for driving into rotation the rotating device around the axis of the grinding tool; and a system for controlling a so-called reference position representative of the position of the axis of the grinding tool, the control system actuating the third driving means so that me rotating device occupies an angular position relatively to the axis of the grinding tool so as to keep a safety angle preventing any collision between the knurl, the part to be machined and machine units, while allowing the part and the grinding tool to be optimally sprayed by at least one spraying nozzle.

11. The machine tool according to claim 10, wherein the third driving means include either a gear formed by a central sprocket wheel (122) the axis of which coincides with the axis of the grinding tool and a peripheral sprocket wheel (123) integral with the rotating device bearing the Knurl, or a system with synchronous belt and pulley.

12. The machine tool according to claim 11, wherein the machining system comprises a motorized component connected to said system for controlling the reference position for rotating the peripheral sprocket wheel (123) around the central sprocket wheel (122) in any direction of rotation according to a reference position.

13. The machine tool according to claim 11, wherein the machining system comprises a motorized component connected to said system for controlling the reference position rotating the peripheral sprocket wheel (123) around the central sprocket wheel (122) in any direction at rotation according to a machining program.

14. The machine tool according to claim 1, wherein the main spindle is driven into rotation by an adjustable speed electric motor and provided with means for reversing the direction of rotation.

15. The machine tool according to claim 1, wherein the profiling knurl is diamondized and driven into rotation by the secondary spindle via an adjustable speed electric or air motor.

16. The machine tool according to claim 1, wherein a spraying system is bound to the rotating device for spraying the part.

* * * * *

UNITED STATES PATENT AND TRADEMARK OFFICE

CERTIFICATE OF CORRECTION

PATENT NO. : 7,195,543 B2
APPLICATION NO. : 10/959593
DATED : March 27, 2007
INVENTOR(S) : Cousin It is certified that error appears in the above-identified patent and that said Letters Patent is hereby corrected as shown below:

On the title page item (54), line 3, delete "PROFILLING" and insert -- PROFILING --, therefor.

Col. 1, title, line 3, delete "PROFILLING" and insert -- PROFILING --, therefor.

Claim 2, col. 7, line 39, after "axis of" insert -- the --.

Signed and Sealed this

Third Day of July, 2007

JON W. DUDAS
*Director of the United States Patent and Trademark Office*